US007642977B2

(12) United States Patent
Seo

(10) Patent No.: US 7,642,977 B2
(45) Date of Patent: Jan. 5, 2010

(54) EXTENDABLE BUILT-IN ANTENNA UNIT OF MOBILE DEVICE

(75) Inventor: Sung In Seo, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 154 days.

(21) Appl. No.: 11/709,313

(22) Filed: Feb. 21, 2007

(65) Prior Publication Data

US 2008/0074333 A1 Mar. 27, 2008

(30) Foreign Application Priority Data

Aug. 3, 2006 (KR) ..... 10-2006-0073405

(51) Int. Cl.
*H01Q 1/24* (2006.01)
*H01Q 21/00* (2006.01)
*H01Q 1/00* (2006.01)
*H01Q 1/10* (2006.01)

(52) U.S. Cl. ..... 343/729; 343/702; 343/725; 343/895; 343/901; 455/575.7

(58) Field of Classification Search ..... 343/702, 343/901, 725, 729, 895; 455/575.7
See application file for complete search history.

(56) References Cited

U.S. PATENT DOCUMENTS

| | | | | |
|---|---|---|---|---|
| 6,285,340 | B1 * | 9/2001 | Park et al. | 343/895 |
| 6,317,086 | B1 * | 11/2001 | Woo | 343/702 |
| 6,417,808 | B1 * | 7/2002 | Ide | 343/702 |
| 6,445,347 | B1 * | 9/2002 | Yoshimi | 343/702 |
| 6,507,317 | B1 * | 1/2003 | Kalish | 343/702 |
| 6,768,464 | B1 * | 7/2004 | Shoji et al. | 343/702 |
| 7,292,192 | B2 * | 11/2007 | Aritake | 343/702 |
| 7,427,958 | B2 * | 9/2008 | Yoon et al. | 343/702 |
| 2007/0080874 | A1 * | 4/2007 | Jeon et al. | 343/702 |

FOREIGN PATENT DOCUMENTS

JP 11243310 A * 9/1999

* cited by examiner

*Primary Examiner*—Douglas W Owens
*Assistant Examiner*—Jennifer F Hu
(74) *Attorney, Agent, or Firm*—The Farrell Law Firm, LLP

(57) ABSTRACT

An extendable built-in antenna unit for a mobile device is disclosed that includes a whip antenna, a helical antenna, an antenna receiving part and an intenna pattern. The helical antenna may be extractably and retractably mounted in the antenna receiving part. The whip antenna may be extractably and retractably mounted in the helical antenna. The helical antenna and the intenna pattern may be formed with lengths determined according to the resonance frequency.

7 Claims, 5 Drawing Sheets

EXTENDABLE BUILT-IN ANTENNA UNIT OF MOBILE DEVICE

PRIORITY

This U.S. non-provisional application claims benefit of priority under 35 U.S.C. §119 of Korean Patent Application No. 2006-73405, filed on Aug. 3, 2006, the contents of which are incorporated herein by reference.

BACKGROUND OF THE INVENTION

1. Field of the Invention

The present invention relates to an extendable built-in antenna unit for a mobile device, and more particularly to an extendable built-in antenna unit for a mobile device serving as a combination of embedded antenna and external antenna.

2. Background of the Related Art

Generally, a mobile device is a mobile telecommunication application having a variety of functions, for example telecommunication, network connections, and digital broadcast reception. The mobile device has an antenna for improved telecommunication.

The antenna is a wire used in radiating electric waves and/or inducing electromotive force using electric waves for wireless communication. An antenna unit may be electrically connected to a substrate and have a helical antenna and a whip antenna.

Conventionally, an antenna unit for a mobile device may be formed of an external antenna type, in which a helical antenna protrudes outwards from the mobile device. In the conventional external antenna type, a whip antenna may be received in the helical antenna or may protrude from the helical antenna. While external antenna type may provide good antenna performance, it may adversely influence the portability and external design of the mobile device.

FIG. 1 is a partial cross-sectional view of a conventional external antenna unit for a mobile device 100.

Referring to FIG. 1, the external antenna unit may include a whip antenna 120, a helical antenna 130, and an antenna receiving part 110. The helical antenna 130 may be formed in a spring pattern. A case 132 may surround the helical antenna 130. A grooved part 131 may be attached to the mobile device 100 and be configured to secure the helical antenna 130 to the mobile device 100. The case 132 may have a hole, through which the whip antenna 120 may pass.

The whip antenna 120 may be extractably and retractably mounted in the mobile device 100. For example, the whip antenna 120 may be inserted in the antenna receiving part 110 or may be extracted from the antenna receiving part 110. A stopper 121 may be formed on a lower surface of the whip antenna 120 and be configured to prevent the separation of the whip antenna 120 from the mobile device 100.

When the mobile device 100 is located in a strong electric field with good reception, the mobile device 100 may be used such that the whip antenna 120 may be retracted in the antenna receiving part 110. When the mobile device 100 is located in a poor electric field, the mobile device 100 may be used such that the whip antenna 120 may be extended outwards from the antenna receiving part 110 for improved performance.

If the helical antenna 130 is embedded in the mobile device 100, the resonance of the helical antenna 130 may disappear. Therefore, the helical antenna 130 is installed outside the mobile device 100, resulting in the mobile device 100 having a protruding portion of an antenna unit.

An embedded antenna unit (referred to as an intenna) has been developed in which a helical antenna may be installed in a mobile device. The embedded antenna unit may be incorporated by an inverted F-type antenna. The embedded antenna unit may provide portability and good external design. However, the embedded antenna unit has a difficulty in solving the problem that the resonance of the helical antenna may disappear when the helical antenna is installed in the mobile device, thereby suffering poor antenna performance.

Recent trends of mobile devices have moved towards good external design and miniaturization. Moreover, the mobile devices may be multifunctional, for example providing telecommunication, wireless Internet communication, navigation, digital broadcast reception, and Bluetooth communication. Accordingly, various frequency bands may be specified and a plurality of frequency bands may be utilized in a mobile device. Conventional external antenna unit have limitations in meeting the trends.

SUMMARY OF THE INVENTION

An exemplary embodiment of the present invention to provide an extendable built-in antenna unit which may be selectively used as an embedded antenna type or an external antenna type according to electric field condition.

An exemplary embodiment of the present invention may provide an extendable built-in antenna unit can provide the improved helical antenna performance while maintaining using an intenna pattern.

According to the present invention, an extendable built-in antenna unit for a mobile device includes an antenna receiving part, a helical antenna and a whip antenna. The antenna receiving part is formed in the mobile device and has a first portion and a second portion. The helical antenna is extractably and retractably mounted in the antenna receiving part. The whip antenna is extractably and retractably mounted in the helical antenna.

The extendable built-in antenna unit further includes an intenna pattern formed in the second portion of the antenna receiving part. The intenna pattern prevents degradation of antenna performance that may occur when the helical antenna is received in the antenna receiving part.

When the helical antenna and the whip antenna are received in the antenna receiving part, signals may be transmitted through the helical antenna and the intenna pattern.

The extendable built-in antenna unit further includes a feed point and a first contact formed in the first portion of the antenna receiving part. The first contact is connectable to the feed point.

The extendable built-in antenna unit further includes a second contact formed in the second portion of the antenna receiving part. The second contact may be connected to the intenna pattern.

The extendable built-in antenna unit further includes a plurality of intenna patterns. In addition, the intenna patterns may have different lengths according to frequency bands. The second contact may be connected to a ground to allow a longer intenna pattern to be formed. The helical antenna may have a case. The case may have a hole, through which the whip antenna may pass. The helical antenna may be wholly inserted in the antenna receiving part.

BRIEF DESCRIPTION OF THE DRAWINGS

The above and other objects, features and advantages of the present invention will become more apparent from the following detailed description in conjunction with the accompanying drawings, in which.

DETAILED DESCRIPTION OF THE PREFERRED EMBODIMENTS

Hereinafter, exemplary embodiments of the present invention are described in detail with reference to the accompanying drawings. Some constructions or processes known in the art may not be described to avoid obscuring the invention in unnecessary detail. In addition, the meaning of specific terms or words used in the specification and the claims should not be limited to the literal or commonly employed sense, but should be construed in accordance with the spirit of the invention. The description of the various embodiments is to be construed as exemplary only and does not describe every possible instance of the invention.

Figure 1:
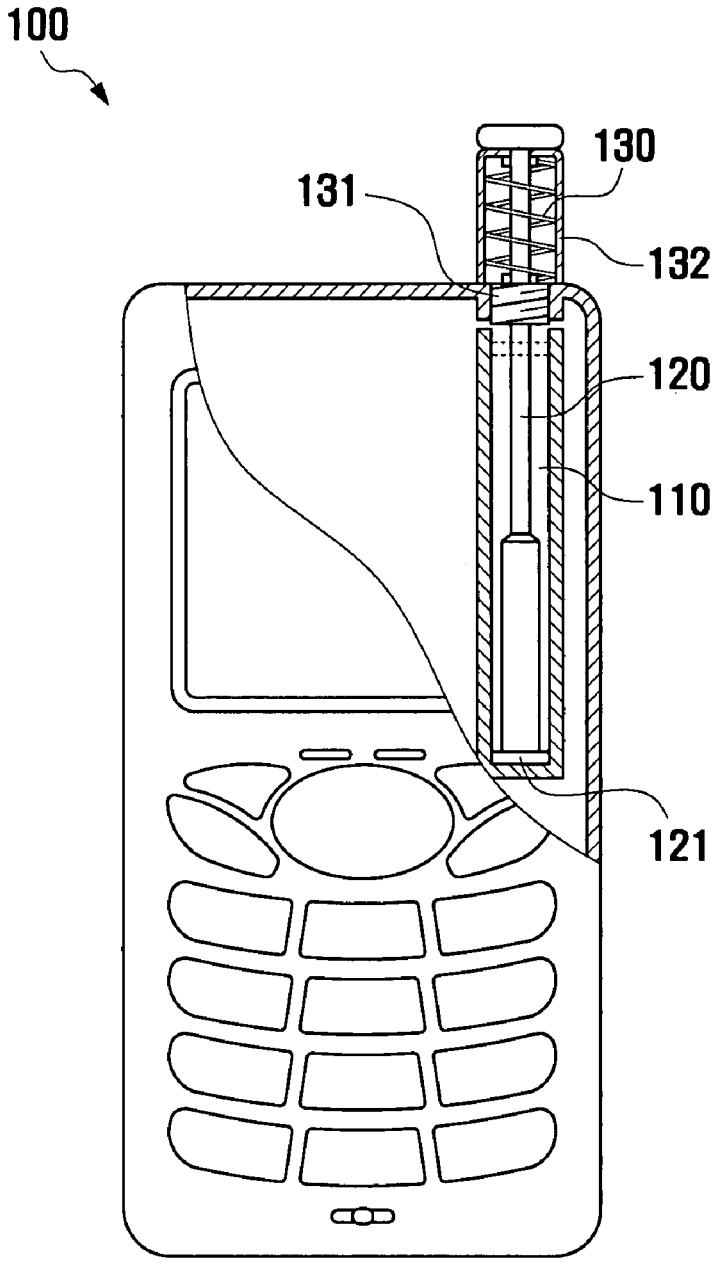
FIG. 1 (Conventional Art)
FIG. 1 is a partial cross-sectional view of a conventional external antenna unit for a mobile device.
Figure 2:
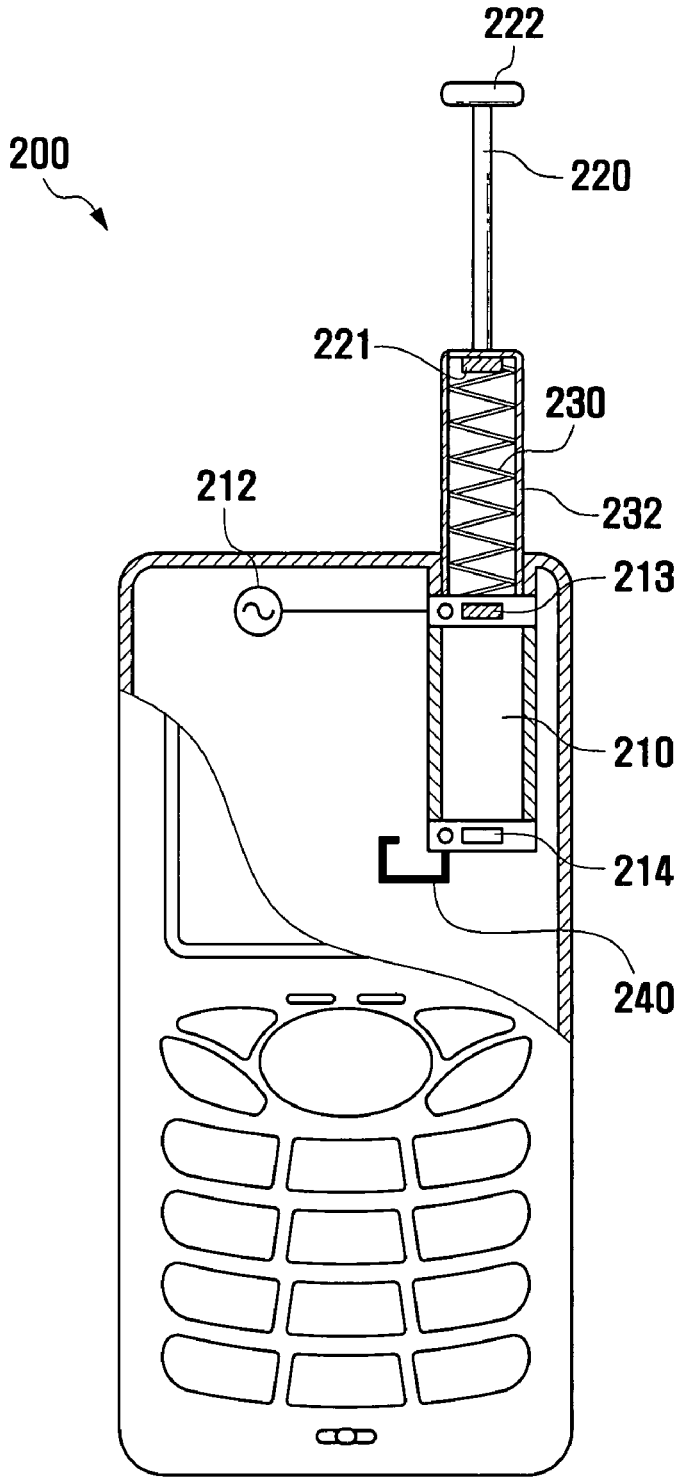
FIG. 2 is a partial cross-sectional view illustrating retraction of an extendable built-in antenna unit for a mobile device according to the present invention.

FIG. 2 is a partial cross-sectional view illustrating retraction of an extendable built-in antenna unit for a mobile device 200 according to the present invention.

Referring to FIG. 2, the antenna unit may include an antenna receiving part 210, a whip antenna 220, and a helical antenna 230. The antenna receiving part 210 may be an empty space configured to receive the whip antenna 220 and the helical antenna 230. The helical antenna 230 may be received in the antenna receiving part 210. Preferably, the helical antenna 230 may be wholly inserted in the antenna receiving part 210, thereby allowing the mobile device 200 to be formed as an embedded antenna type.

The antenna receiving part 210 may have a first portion and a second portion. A first contact 213 may be formed in the first portion and a second contact 214 may be formed in the second portion. An intenna pattern 240 may be formed to be connected to the second contact 214.

The helical antenna 230 may be formed in a spring pattern. A case 232 preferably surrounds the helical antenna 230 and has a hole through which the whip antenna 220 may pass.

The helical antenna 230 preferably has one contact point corresponding to the first contact 213 of the antenna receiving part 210, and another contact point corresponding to the second contact 214 of the antenna receiving part 210. The contact points of the helical antenna 230 are connectable to the corresponding contacts 213 and 214 of the antenna receiving part 210, when the helical antenna 230 is received in the antenna receiving part 210.

The whip antenna 220 is preferably formed as a rod, with a stopper 222 formed at the top of the whip antenna 220 configured to prevent the whip antenna 220 from becoming inextractably fixed in the case 232 of the helical antenna 230.

The mobile device 200 preferably includes a feed point 212. The feed point 212 connects the helical antenna 220 through the first contact 213. The helical antenna 230 may be extractably and retractably mounted to the antenna receiving part 210. For example, the helical antenna 230 may be retracted in the antenna receiving part 210 or may be extracted outwards from the antenna receiving part 210.

The whip antenna 220 is preferably extractably and retractably mounted to the helical antenna 230. For example, the whip antenna 220 may be inserted in the helical antenna 230 through the hole of the case 232 or may be extended outwards from the helical antenna 230. Preferably, the whip antenna 220 may be inserted in a space that may be created in the spring of the helical antenna 230.

When the mobile device 200 is located in a good electric field, the mobile device 200 may be used as an embedded antenna type mobile device, in which the whip antenna 220 and the helical antenna 230 may be received in the antenna receiving part 210. Signals may be transmitted using the helical antenna 230 and the intenna pattern 240. For example, modulated signals from a circuit may be, sent to the helical antenna 230 and the intenna pattern 240 via the feed point 212. Signals received through the helical antenna 230 and the intenna pattern 240 may be transmitted to a circuit via the feed point 212.

The helical antenna 230 and the intenna pattern 240 may be formed with lengths determined according to the resonance frequency. Thereby, resonance may be retained and antenna performance may not decrease even when the helical antenna 230 is received in the mobile device 200. The intenna pattern 240 may be formed considering radiation performance and available space.

Figure 3:
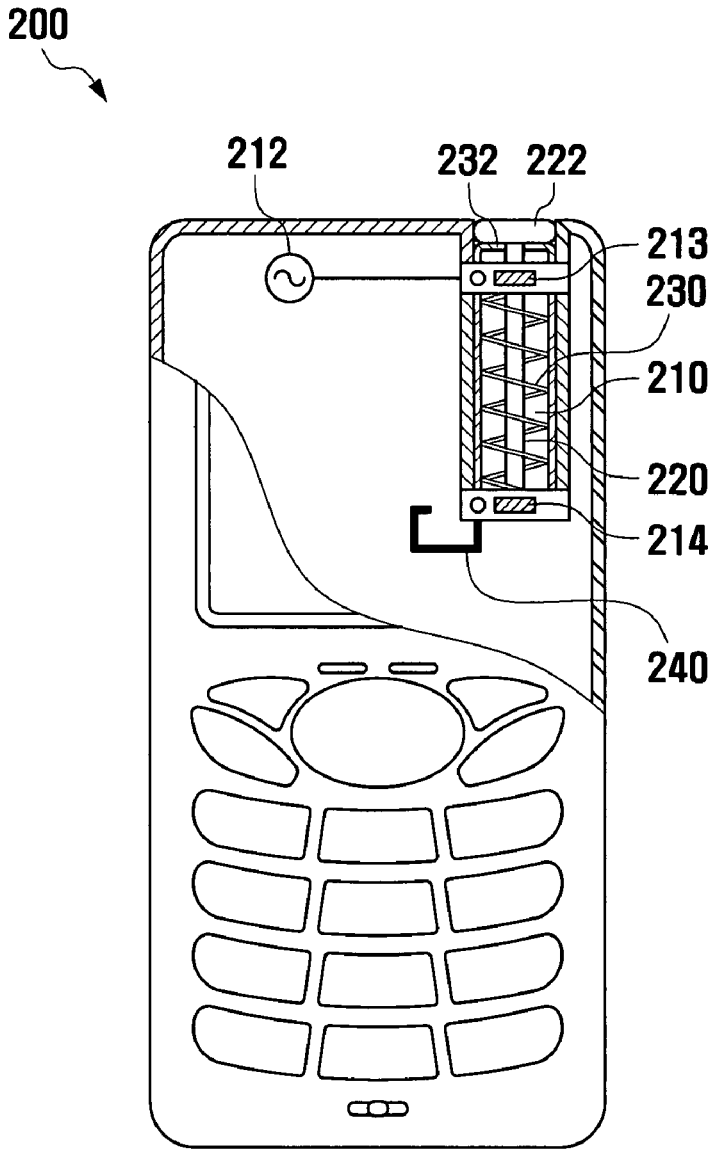
FIG. 3 is a partial cross-sectional view illustrating extraction of the extendable built-in antenna unit for a mobile device of FIG. 2.

FIG. 3 is a partial cross-sectional view illustrating extraction of the extendable built-in antenna unit for the mobile device 200 in FIG. 2. Referring to FIG. 3, when the mobile device 200 is in a poor electric field, the mobile device 200 may be configured used as an external antenna type mobile device, in which the whip antenna 220 and the helical antenna 230 protrude outwards from the mobile device 200. A stopper 221 may be formed at the bottom of the whip antenna 220 and be configured to prevent the whip antenna 220 from being extracted through the hole of the case 232 of the helical antenna 230 and being separated from the mobile device 200.

Signals may be transmitted using the helical antenna 230 and the whip antenna 220. For example, modulated signals from a circuit may be sent to the helical antenna 230 and the whip antenna 220 via the feed point 212. Signals received through the whip antenna 220 and the helical antenna 230 may be transmitted to a circuit via the feed point 212.

In alternative embodiments, the helical antenna 230 may protrude outwards from the antenna receiving part 210 and the whip antenna 220 may be inserted in the helical antenna 230.

Figure 4:
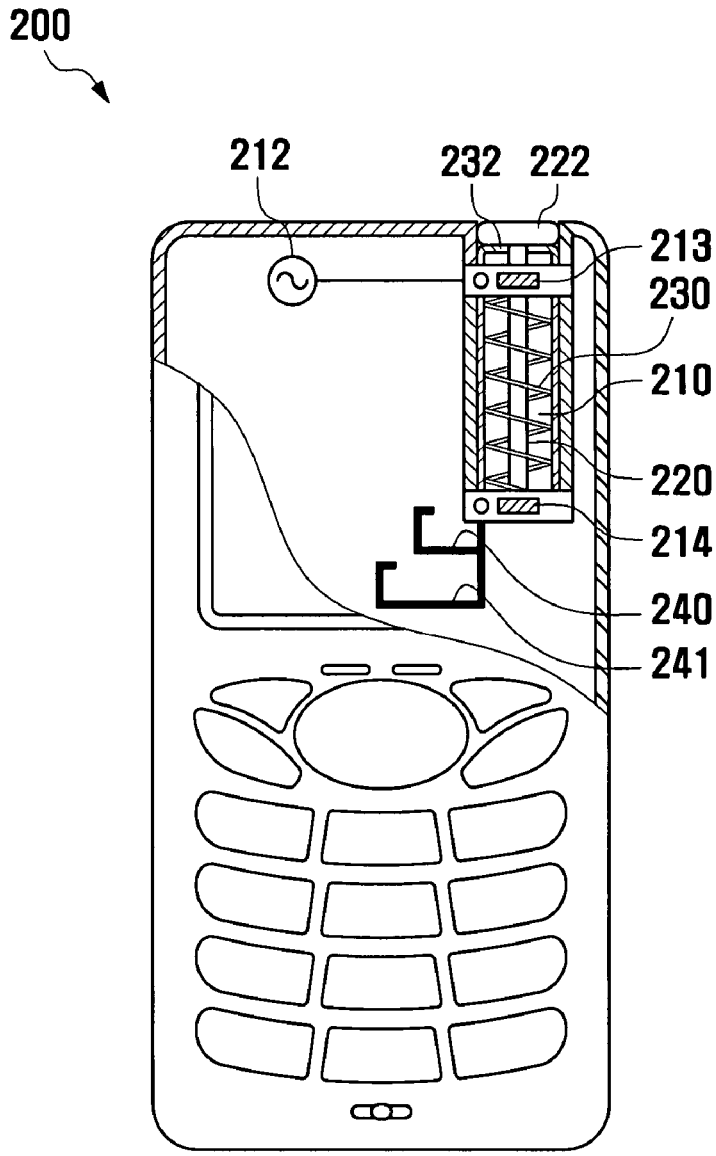
FIG. 4 is a partial cross-sectional view of an extendable built-in antenna unit for a mobile device according to another embodiment of the present invention.

FIG. 4 is a partial cross-sectional view of an extendable built-in antenna unit for the mobile device 200 according to another embodiment of the present invention.

Referring to FIG. 4, the mobile device 200 may have a plurality of intenna patterns for a plurality of resonance frequencies. Each intenna pattern preferably has a different length. Thereby the antenna unit may operate in a plurality of frequency bands.

For example, the antenna unit may have a first intenna pattern 240 and a second intenna pattern 241. The length of the first intenna pattern 240 may be formed in conformity with the resonance frequency for telecommunication, and the length of the second intenna pattern 241 may be formed in conformity with the resonance frequency for navigation. Thereby telecommunication signals and navigation signals may be transmitted using a single antenna unit.

A conventional mobile device may require a plurality of antenna units to transmit signals of different frequency bands. According to the present invention, the mobile device 200 may transmit signals of different frequency bands using the intenna patterns 240 and 241 instead of multiple antenna units, thereby resulting in a small-sized mobile device.

Figure 5:
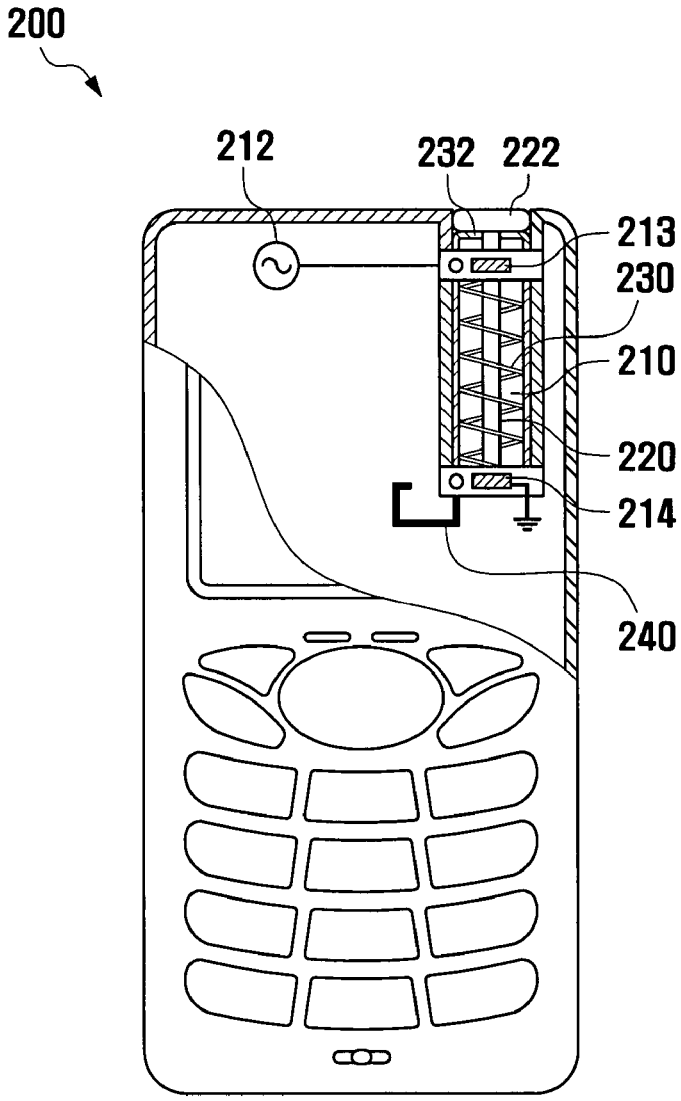
FIG. 5 is a partial cross-sectional view of an extendable built-in antenna unit for a mobile device according to another exemplary embodiment of the present invention.

FIG. 5 is a partial cross-sectional view of an extendable built-in antenna unit for the mobile device 200 according to another embodiment of the present invention.

Referring to FIG. 5, a second contact 214 may be connected to a ground. The length of an intenna pattern 240 connected to a ground may be formed longer than that of an intenna pattern not connected to a ground. The intenna pattern 240 may be formed with a direction and a length determined for improved antenna performance.

The mobile devices include mobile electronic apparatus, for example mobile phones, Personal Digital Assistants (PDAs), Global Positioning system (GPS), navigators, or digital broadcast receivers.

In accordance with the exemplary embodiments of the present invention, a mobile device uses an extendable built-in antenna unit as an embedded antenna type in a good electric field and uses an external antenna type in a poor electric field.

The extendable built-in antenna unit may have an intenna pattern. The intenna pattern may prevent degradation of antenna performance that may occur when a helical antenna is positioned inside a mobile device. Further, the extendable built-in antenna unit may have a plurality of intenna patterns for a plurality of frequency bands, resulting in a small-sized mobile device.

Although exemplary embodiments of the present invention have been described in detail hereinabove, it should be understood that many variations and/or modifications of the basic inventive concept herein described, which may appear to those skilled in the art, will still fall within the spirit and scope of the exemplary embodiments of the present invention as defined in the appended claims.

What is claimed is:

1. An extendable built-in antenna unit for a mobile device, the antenna unit comprising:

an antenna receiving part formed in the mobile device, having a first portion and a second portion;

a helical antenna extractably and retractably mounted in the antenna receiving part;

a whip antenna extractably and retractably mounted in the helical antenna, a feed point formed in the first portion of the antenna receiving part; and an intenna pattern formed in the second portion of the antenna receiving part, wherein, when the helical antenna and the whip antenna are retracted, the helical antenna and the whip antenna are wholly inserted in the antenna receiving part, and the helical antenna is connected to the feed point and the intenna pattern, and signals are transmitted through the helical antenna and the intenna pattern, and wherein, when the helical antenna and the whip antenna are extracted, the helical antenna and the whip antenna connect in series, and the helical antenna is connected to the feed point, and signals are transmitted through the helical antenna and the whip antenna.

2. The extendable built-in antenna unit of claim 1, further including a first contact formed in the first portion of the antenna receiving part, wherein the first contact is connected to the feed point.

3. The extendable built-in antenna unit of claim 1, further including a second contact formed in the second portion of the antenna receiving part, wherein the second contact is connected to an intenna pattern.

4. The extendable built-in antenna unit of claim 1, further including a plurality of intenna patterns.

5. The extendable built-in antenna unit of claim 4, wherein each of the intenna patterns has a different length.

6. The extendable built-in antenna unit of claim 3, wherein the second contact is connected to a ground.

7. The extendable built-in antenna unit of claim 1, wherein the helical antenna has a case, and the case has a hole, through which the whip antenna passes.

* * * * *